US005241892A

United States Patent [19]

Ousterhout

[11] Patent Number: 5,241,892

[45] Date of Patent: Sep. 7, 1993

[54] METHOD AND APPARATUS FOR TIME SETTING BALLISTIC FUZES

[75] Inventor: James H. Ousterhout, Janesville, Wis.

[73] Assignee: Accudyne Corporation, Janesville, Wis.

[21] Appl. No.: 386,258

[22] Filed: Jul. 28, 1989

[51] Int. Cl.[5] ..... F42C 17/00

[52] U.S. Cl. ..... 89/6.5

[58] Field of Search ..... 89/6.5, 6

[56] References Cited

U.S. PATENT DOCUMENTS

| | | | |
|---|---|---|---|
| 3,622,987 | 11/1971 | Borkan | 89/6.5 |
| 3,814,017 | 6/1974 | Backstein et al. | 89/6.5 |
| 4,142,442 | 3/1979 | Tuten | 89/6.5 |
| 4,144,815 | 3/1979 | Cumming et al. | 89/6.5 |
| 4,454,815 | 6/1984 | Beck | 89/6.5 |
| 4,495,851 | 1/1985 | Koerner et al. | 89/6.5 |
| 4,664,013 | 5/1987 | Wegner et al. | 89/6.5 |
| 4,862,785 | 9/1989 | Ettel et al. | 89/6.5 |

*Primary Examiner*—David H. Brown
*Attorney, Agent, or Firm*—Howard M. Herriot

[57] ABSTRACT

Disclosed is a method of and apparatus for remotely time setting a ballistic fuzing device from an off-board setting device non-conductively coupled to the fuzing device. The fuzing device has a free running or astable multivibrator with non specific frequency tolerance specifications In the practice of the invention, the fuzing device contains a means of generating a time base from a conventionally designed multivibrator circuit, such as an R/C circuit, but not one that utilizes a quartz crystal as its time base. Said multivibrator is set into oscillation during a programming time, at which time the frequency or period of oscillation is measured, and via proper electronic circuits said period is transmitted from the fuzing device to a setting device via a nonconductive link. The setting device, off-board the fuzing device, is so constructed that it reads the period and performs a calculation based thereon and on the specific function time which has been prior set into said setting device by the user thereof The calculation is then returned as electronic impulses back to the fuzing device through the nonconductive data link system The fuzing device then by conventional digital methods reads and stores the calculation which represents a specific function time for that fuzing device based upon the frequency of oscillation of its multivibrator.

7 Claims, 1 Drawing Sheet

METHOD AND APPARATUS FOR TIME SETTING BALLISTIC FUZES

BACKGROUND OF THE INVENTION

Known in the prior art are military ballistic fuzes having a tuning fork crystal time base These conventional military ballistic time fuzes traditionally employ expensive and sophisticated methods to precisely control the detonate time of the device. The crystal controlled oscillator is a component of each fuze. Said crystals, which are fragile, must be capable of withstanding the extreme impact forces imparted to them during the ejection of the fuze from the firing device, which in most cases are in the thousands of g range. It is costly to provide such capability to said crystals. Since these crystals have the disadvantage of being very costly, they are in some situations cost prohibitive when military ballistic fuzes are manufactured in the hundred of thousands quantities.

Normally a conventional military ballistic time fuze system employs the crystal controlled oscillator regardless of expense, since until the advent of this invention no other method has been devised to eliminate the crystal and still maintain the required time accuracy demanded in military time fuze applications. Said crystals must withstand all the rigors of the military environment including temperature extremes, shock and vibration, etc. Since the crystal is manufactured of quartz it is a fragile device, and even though quartz crystals can be made to withstand the rigors of ballistic impacts during ejection, it is expensive to do so, and common practice usually dictates, that to insure total reliability, redundancy be employed. Redundancy in this case means duplication of the crystal and associated circuitry. Naturally, redundancy automatically further increases cost.

Prior art fuze programmers have used a contact system or plug in arrangement to transfer signals between programmer and fuze, and accordingly have the problem of sealing the contacts and keeping them clean in the field. Prior art fuze devices have set mission parameters with a thumbwheel arrangement or some mechanical arrangement of ring switches about the nose cone of the fuze. Such arrangements are disadvantageous because of difficulty of sealing the switches while still maintaining low cost. There are also problems with setting the switches with arctic gloves and NBC clothing.

Cost factors are major considerations in military budgets, especially when small unit costs on an individual unit are multiplied by hundreds of thousands or even millions of times. It therefore becomes important to consider other ways to achieve cost effectiveness while maintaining precise control of the fuze time. Hence the need for the invention.

SUMMARY OF THE INVENTION

It is an object of the invention to provide a conventional non-crystal, free running or astable multivibrator in a military ballistic fuze device which must, by virtue of mission profile, produce an internal timing function during its assigned flight sequence either for purposes of primary detonation or other non-detonation functions such as arming timing, or any other internal timing function.

It is an object to provide a fuze having an R/C oscillator or other non-crystal controlled oscillator as the primary time base generator of the fuze. Because R/C oscillators and other non-crystal oscillators are fairly unstable over wide temperature ranges, it is an object of this invention to provide, from off-board the fuze, compensation for temperature change, by: reading the frequency of the oscillator during the programming period, prior to launch; making the proper adjustment by calculating counts based on the preselected time setting and the frequency read; and transmitting the calculated counts to the time storage register of the fuze.

It is also an object of the invention to provide an external or off-board means, such as a setting device, for interrogating the period or frequency of the on-board free running multivibrator during a programming phase of the fuze device and, then, based upon said period, returning to the fuzing device corrected timing information which the fuzing device will use during its intended flight mission. It is an object of the invention to do such interrogating and information returning via nonconductive coupling, without any conductive connection between the off-board setting device and the fuze or anything on board the fuze. Whenever there is conductive linkage, or electrical contacts, between setter/programmer and fuze, there is an environmental problem of sealing the contacts.

DETAILED DESCRIPTION

Figure 1:
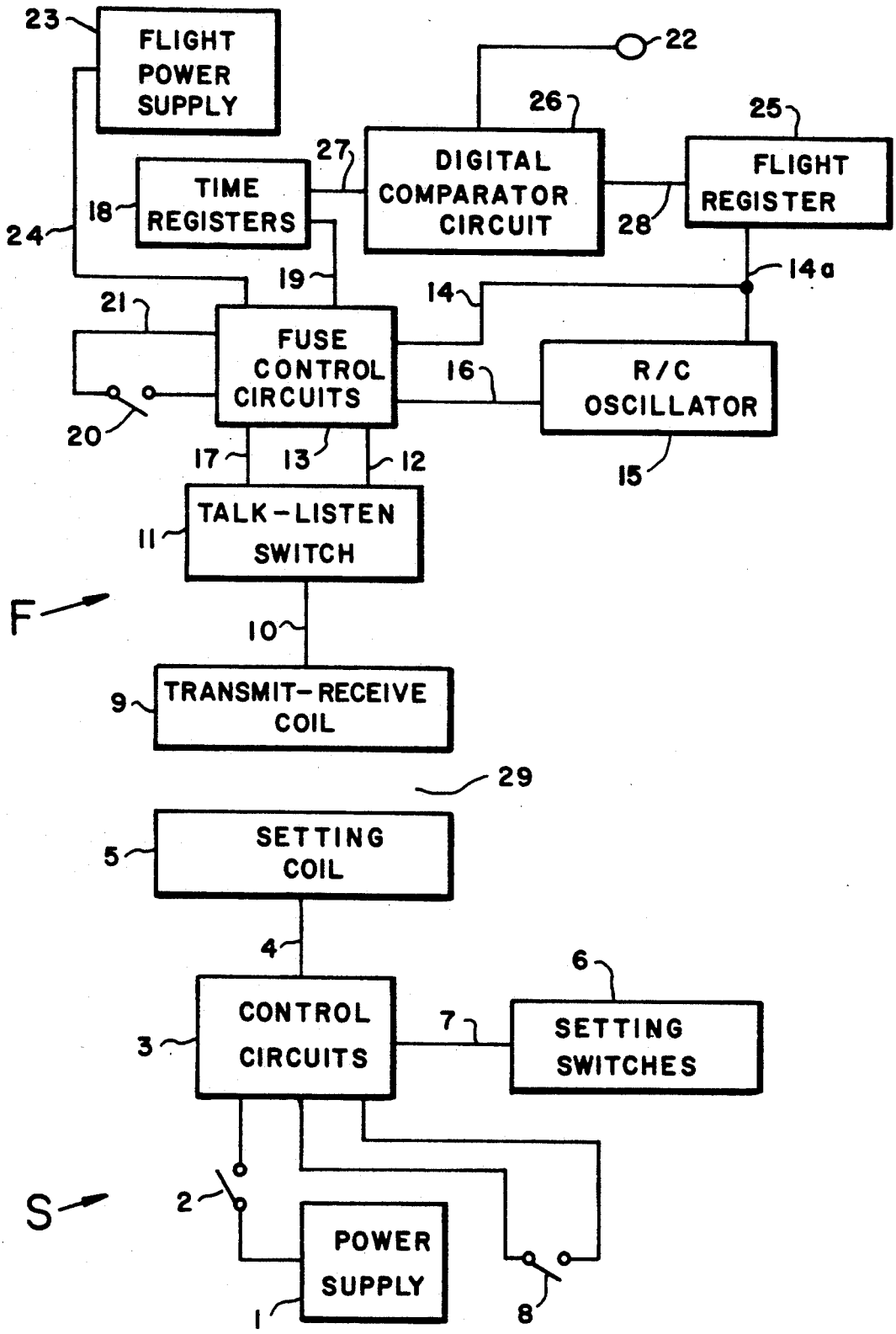
FIG. 1, the only FIGURE, is a block diagram illustrating the off-board setting device S and the on-board fuzing device F of the invention.

The elements of the invention are illustrated in FIG. 1, which shows two separate devices, namely, the setting devices off-board or apart from the fuze, shown on the left; and the fuzing device F, shown on the right, which is on-board as a part of the fuze. Setting device S may be incorporated into a small plastic-encased hand-held calculator-sized unit, or into an enclosure for gun mounting. It can easily be made small and inexpensive so it is not a serious matter if lost or broken.

During the time setting process, power is supplied to setting control circuitry 3 from power supply 1 by closing switch 2. Fuze time mission parameters are set by setting switches 6, and are fed into setting control circuitry 3 via wire link 7. Setting coil 5 may be positioned over or in close proximity to transmitting and receiving coil 9 of the fuze device, so as to be inductively coupled thereto, but has no conductive connection thereto. Set button 8 is pressed to start a programming sequence in the setting control circuitry 3. This generates an initial sequence of setting data which is sent via wire link 4 to setting coil 5. This setting data is inductively transmitted from setting coil 5 across air gap 29 into transmitting and receiving coil 9, and is fed via wire link 10 into the talk-listen switch 11. In the listen mode setting, data passes via wire link 12 into fuze control circuitry 13. Fuze control circuitry 13, among other things, generates a start signal which is sent via wire link 16 to the astable R/C oscillator 15. The R/C oscillator 15 then generates an alternating digital ones and zeros pattern at or about its center design frequency which is fed via wire line 14 back to the fuze control circuitry 13. At this time, setting control circuitry 3 has finished sending the initial setting data and has switched to a listening mode. Fuze control circuitry 13 generates a talk-signal which is sent via wire link 17 to the talk listen switch 11. Meanwhile the frequency pattern of the R/C oscillator 15 is sent from fuze control circuitry 13 via wire link 17 to the talk listen switch 11 which in turn feeds the signal via wire link 10 to the transmitting and receiving coil 9. Wire link 10 is a two way communication channel The setting control circuitry 3 has now switched to a listening mode under program control, and the setting coil 5 receives the frequency data being inductively transmitted to it by coil 9.

Setting control circuitry 3 receives the frequency data from setting coil 5 via wire link 4, which also, like wire link 10, is a two way communications channel. Control circuitry 3 now is programmed to perform mathematical calculations based upon the frequency or period of the R/C oscillator 15 in conjunction with the time settings which have been manually set by an operator on setting switches 6. Setting control circuitry 3 then continues the programming sequence, and, using the mathematical calculations, generate a series of set time data pulses representing the set time contained in the setting switches 6. These pulses are sent via wire link 4 to setting coil 5 and are inductively transmitted across air gap 29 to transmitting and receiving coil 9, and are then sent to talk listen switch 11 via wire link 10, and are finally sent to fuze control circuitry 13 via wire link 12. Fuze control circuitry 13, under hardware control, then directs the pulses to time registers 18 via wire link 19. Time registers 18 store the set time data pulses for use during the ballistic fuze flight.

At this time, the setting control circuitry 3 has completed the programming cycle and has shut off. The fuze control circuitry 13 also completes the programming cycle and produces a standby signal on wire link 16 which shuts off R/C oscillator 15. A standby voltage is maintained on all circuits from a storage device (not shown) within fuze control circuitry 13. The fuzing device is now set with proper time data, and waits to be launched from a gun, or otherwise launched.

At launch time, flight power supply 23 becomes active and supplies flight power to all circuits via wire link 24. Impact switch 20 closes due to setback forces created by the launch and, via wire link 21, permits fuze control circuitry 13 to generate a start signal, which is sent via wire link 16 into R/C oscillator 15. The oscillator then produces an alternating ones and zeros patten which is fed to fuze control circuitry 13 and flight register 25 over wire links 14 and 14*a*. Flight register 25 is incremented by the ones and zeros output from the R/C oscillator 15. The output data from the flight register 25 is fed to a digital comparator circuit 26 via wire link 28. Time set data from time register 18 is also fed to digital comparator 26 via wire link 27. When data from the time register 18 compares with incremented data from flight register 25, a compare pulse 22 is produced at the output of digital comparator 26. The compare pulse 22 represents the fire time, or any other programmed time which may be in accordance with the fuze type and mission This pulse 22 is fed to the appropriate detonator control element or other control element on the fuzing device.

Fuzing device F may have its entire electronic processing section on a single low cost integrated circuit chip. The only additional circuitry needed is a small number of supporting components. Setting device S, as stated earlier can be a handheld item. It is simple, using a microprocessor chip, a few support components, some rugged switches, a battery and a coil.

Coil 9 of device F may be on the nose cone of the fuze, and the portable device S, when used, may be placed over or near the nose cone, to put coil 5 into effective inductive linkage with coil 9.

To provide power to the fuze for electrically activating the fuze before launch, this invention during the initial programming time, inductively couples and transmits, via that coupling, a bit stream to the fuze from the off-board device that contains no data. The energy contained in the bit stream charges a capacitor (not shown) in the fuze control circuitry on the fuze. The charge remains on the capacitor for a considerable length of time after programming and functions as the primary voltage source to supply power to the fuze electronics during the programming time. After launch, the fuze receives power from its conventional primary source, such as a turbine alternator or a reserve energy battery A logic start signal is generated at launch by sensing an impact switch closure, and this start signal wakes up the R/C oscillator, and the timing function begins. The storage capacitor supplies the power to the logic until the conventional primary source of power takes over in milliseconds after launch.

While the elements and operating principles of the invention have been made clear herein, it will be immediately obvious to those skilled in the art of ballistic time fuze making, that many modifications may be made in the illustrated embodiment and in its digital architecture, circuit structure, programming sequences, power distribution, transmission and receiving methods used in the practice of the invention, without departing from the invention claimed.

What is claimed is:

1. A system for time setting a ballistic fuze from off-board the fuze, the system comprising an on-board device on the fuze having fuze control and operating means including a non-crystal oscillator, digital reading and storage means, and transmitter-receiver means, and an off-board device apart from the fuze having sending—receiving means non-conductively linked to the transmitter—receiver means and including: means for pre-setting the fuze time and; means for activating the oscillator and reading the frequency thereof, through the non-conductive linkage for calculating a number of counts based on the time pre-set and the frequency read, and for transmitting the calculated counts through the non-conductive linkage to the reading and storage means on the fuze.

2. The system of claim 1 wherein: the non-crystal oscillator is the only oscillator of the on-board device; and the non-conductive linkage is the sole linkage between the on-board and off-board devices, there being no conductive connection therebetween.

3. The system of claim 1 wherein the oscillator is an R/C oscillator.

4. The system of claim 1 wherein the non-conductive linkage is inductive.

5. The system of claim 1 wherein the oscillator is an R/C oscillator and the non-conductive linkage is inductive.

6. A system for time setting an item from off-board the item, the system comprising an on-board device on the item having control and operating means including a non-crystal oscillator, digital reading and storage means, and a transmitter - receiver; and an off-board device apart from said item having sending-receiving means non-conductively linked to the transmitter—receiver means and including: means for pre-setting the item time; and means for activating the oscillator and reading the frequency thereof, through the non-conductive linkage, for calculating a number of counts based on the time pre-set and the frequency read, and for transmitting the calculated counts to the reading and storage means on the item, through the non-conductive linkage.

7. The system of claim 6 wherein:

the non-crystal oscillator is the only oscillator of the on-board device; and the non-conductive linkage is the sole linkage between the on-board and off-board devices, there being no conductive connection therebetween.

* * * * *